US009615981B2

(12) United States Patent
Hill

(10) Patent No.: US 9,615,981 B2
(45) Date of Patent: Apr. 11, 2017

(54) SCREEN FOR CONCEALING A PATIENT'S IDENTITY

(76) Inventor: Myheir Ida Hill, Northridge, CA (US)

( * ) Notice: Subject to any disclaimer, the term of this patent is extended or adjusted under 35 U.S.C. 154(b) by 191 days.

(21) Appl. No.: 13/338,308

(22) Filed: Dec. 28, 2011

(65) Prior Publication Data

US 2012/0284916 A1 Nov. 15, 2012

Related U.S. Application Data

(60) Provisional application No. 61/518,564, filed on May 9, 2011.

(51) Int. Cl.
*A61G 1/04* (2006.01)
*A61G 5/10* (2006.01)

(52) U.S. Cl.
CPC *A61G 1/04* (2013.01); *A61G 5/10* (2013.01)

(58) Field of Classification Search
CPC ..... A61G 1/04; A61G 5/10
USPC ..... 5/414, 629, 113, 625, 415, 416; 296/20; 297/184.15, 184.17; 135/96
See application file for complete search history.

(56) References Cited

U.S. PATENT DOCUMENTS 1,702,010 A 2/1929 Klever
4,809,724 A * 3/1989 Fuser ..... A45B 11/00 135/16
4,939,803 A * 7/1990 Waters ..... 5/414
4,959,877 A * 10/1990 Covil ..... 5/423
5,000,210 A * 3/1991 Worthington, Jr. ..... A47C 7/66 135/90
5,511,259 A 4/1996 Tarara
5,921,258 A * 7/1999 Francois ..... 135/88.03
6,017,601 A * 1/2000 Amsel ..... 5/490
6,076,206 A * 6/2000 Celaya ..... 5/414
6,216,711 B1 * 4/2001 Ormanoski ..... A45B 11/00 135/16
6,217,099 B1 * 4/2001 McKinney et al. ..... 5/416
6,644,736 B2 * 11/2003 Nguyen et al. ..... 297/184.17
6,789,557 B1 * 9/2004 Wahl, Jr. ..... A47C 7/66 135/117
8,997,770 B1 * 4/2015 Martin ..... A47C 7/66 135/117
2008/0047061 A1 * 2/2008 Peck ..... 5/413 AM

* cited by examiner

*Primary Examiner* — David E Sosnowski
*Assistant Examiner* — Eric Kurilla

(57) ABSTRACT

A patient handling device in combination with a screen for shielding a patient's face. The screen comprises a movable frame which is movable from a retracted position to a shielded position. The screen further includes means for attaching the movable frame to the patient handling device, and a semi-transparent, or translucent, material secured to the movable frame. The patient is not impeded by the screen in the retracted position when the patient is being placed upon or removed from the patient handling device, and the patient's face is shielded by the screen while in the shielded position.

13 Claims, 4 Drawing Sheets

SCREEN FOR CONCEALING A PATIENT'S IDENTITY

CROSS REFERENCE TO RELATED APPLICATION

This application claims the benefit of U.S. Provisional Application 61/518,564, which was filed on May 9, 2011, the entire disclosure of which is hereby incorporated by reference.

BACKGROUND OF THE INVENTION

1. Field of the Invention

The present invention pertains to a screen for concealing a patient's identity. More particularly, the present invention pertains to a screen for concealing a patient's identity which the patient can see through but which is nontransparent or semi-transparent to bystanders. Even more particularly, the present invention pertains to a screen for concealing a patient's identity, and which the patient and healthcare providers can see through at close range, but which is nontransparent or semi-transparent to bystanders at a further distance.

2. Description of the Prior Art

Patient privacy has become an increasingly important matter to society. For example, the Health Insurance Portability and Accountability Act (HIPAA) places many new privacy requirements upon health insurance companies and health care providers with the goal of protecting patients' privacy. Although the present invention pertains to providing patient privacy by concealing patients' identify, and the privacy provisions in HIPAA pertain to the proper handling of paperwork, HIPAA's mere existence still demonstrates the increased importance that society places on patient privacy and patients' rights.

Hospitals and health care providers have made basic attempts at maintaining patient privacy for many years. For instance, hospitals have used retractable fabric screens in semi-public areas or in multi-patient rooms in an attempt to maintain some level of privacy for each patient. Doctors' offices also typically have separate rooms for treating patients individually. However, these means for protecting patient privacy are directed toward the more obvious situations in which patients may be unclothed or may be discussing highly sensitive matters with their physician or nurse.

But in today's age, people are placing an even greater importance upon patient privacy and rights. Ideally, patients would not even have to share a common waiting room or have it even known to any third party that they even sought medical care. For example, if a patient is spotted by a relative or acquaintance entering or leaving an oncologist's office, the third party may already know or suspect more than the patient would like. Health matters are of the utmost concern in an individual's life, and it is a societal goal to allow each individual total control over the dissemination of any information involving their own health and well-being.

Hospitals are areas of particular concern because they can be very busy and patient privacy is often forced to take a back seat to urgent medical matters. Nonetheless, efforts need to be made to increase or maintain patient privacy as much as reasonably possible.

There does exist in the prior art at least one previous attempt to address this problem in a similar manner as the invention described hereinbelow, namely, U.S. Pat. No. 5,511,259 to Tarara. Tarara discloses a stretcher, or gurney, having a retractable canopy for providing some level of privacy to the patient. The canopy extends upwardly and over the patient's head, and has nontransparent sides and a transparent center portion allowing the healthcare providers to view the patient. However, this device leaves the patient's face completely visible to anyone who is not positioned directly to the side of the patient's head. The patient is clearly visible through the transparent panel to anyone standing near the patient's head. Likewise, the canopy is completely open to any bystanders positioned near or around the patient's body. Therefore, the canopy disclosed by Tarara is not effective at concealing patients' identity.

A similar device is also disclosed in U.S. Pat. No. 1,702,010 to Klever. Klever discloses an ambulance cot, or gurney, which includes a retractable shade which folds upwardly and over the patient's face for the purpose of protecting the patient from the elements during inclement weather. This patent issued in 1929, and patient privacy was of little concern at the time. The purpose of this invention was to solely protect the patient from elements like rain, snow, or direct sunlight. Although Klever conceals the patient more than the device in Tarara, it similarly leaves the patient's face completely exposed to any bystanders positioned near the "foot" end of the stretcher.

Thus, there remains a need for a device for providing patient privacy while the patient is in a public or semi-public environment. And in particular, there is a need for a device which conceals the patient's identity while in these settings.

The present invention, as detailed hereinbelow, seeks to improve upon the prior art by providing a screen which is effective at concealing a patient's identity, yet which also allows the patient to view his or her surroundings outwardly through the screen.

SUMMARY OF THE INVENTION

The present invention provides a patient handling device in combination with a screen for shielding a patient's face, comprising: (a) a movable frame, the movable frame being movable from a retracted position to a shielded position; (b) means for attaching the movable frame to the patient handling device; and (c) a translucent material secured to the movable frame; wherein a patient is not impeded by the screen in the retracted position when the patient is being placed upon or removed from the patient handling device, and the patient's face is shielded by the screen while in the shielded position. The patient handling device can be a bed, a wheelchair, a stretcher, a gurney, or the like.

The translucent material has properties such that the patient can see outwardly from behind the screen, but that a bystander cannot identify the patient's face through the material. Preferably, the translucent material is a plastic film.

The translucent material can also be any suitable fabric which conceals the patient's identity yet allows the patient to view outwardly therethrough. For instance, the material can be a veil.

In another embodiment, the present invention can comprise a screen for shielding a patient's face comprising: (a) a movable frame; (b) means for attaching the movable frame to an apparatus upon which the patient is positioned; and (c) a translucent material attached to the frame.

In yet another embodiment, the present invention can comprise a screen for shielding a patient's face comprising a translucent material, wherein a patient can see clearly outwardly through the material, and a bystander cannot identify the patient through the screen.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
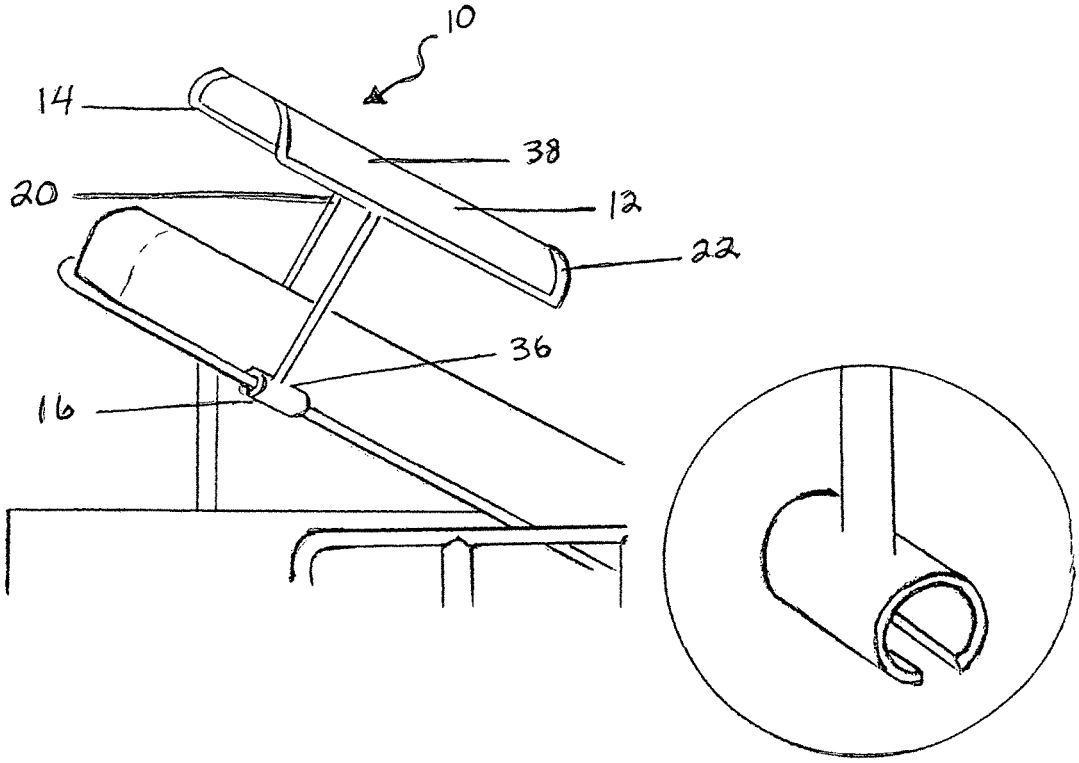
FIG. 1 is a perspective view of a first embodiment of the present invention hereof.

The present invention comprises a screen 10 for shielding a patient's face (not shown) comprising a translucent material 12, wherein the patient can see clearly outwardly through the material 12, yet a bystander (not shown) cannot identify the patient through the screen 10. It is understood that there are countless mechanisms or devices which can be used to embody this invention, including various armatures and linkages. Disclosed hereinbelow are a number of specific embodiments to ensure that one having ordinary skill in the art is enabled to make and use the invention.

In accordance with the present invention, and as shown generally in FIGS. 1-4, there is provided a screen 10 for shielding a patient's face comprising: (a) a movable frame 14; (b) means for attaching 16 the movable frame to an apparatus upon which the patient is positioned; and (c) a translucent material 12 attached to the frame 14.

The movable frame 14 can include any suitable type of armature, linkage, movable joint, framing, or the like in order to provide adequate structure to shield the patient's face behind the translucent material 12. By way of example, FIG. 1 includes a pivotal joint 18 on each side of the screen 10 positioned near the means for attaching 16 the movable frame 14 to the patient handling device 34. Each pivotal joint 18 is attached to a leg 20 extending from a support frame 22 supporting the translucent material 12. In this embodiment, the support frame 22 includes a plurality of interconnected members, upon which the translucent material 12 is attached.

Figure 2:
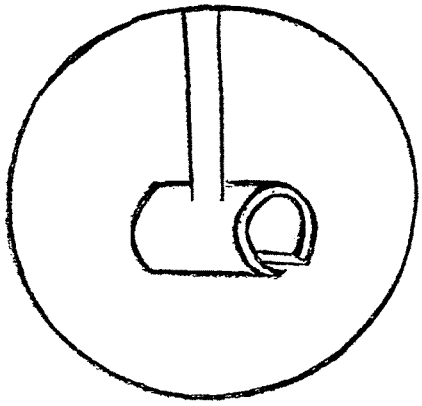
FIG. 2 is a perspective view of a second embodiment of the present invention hereof.
Figure 2:
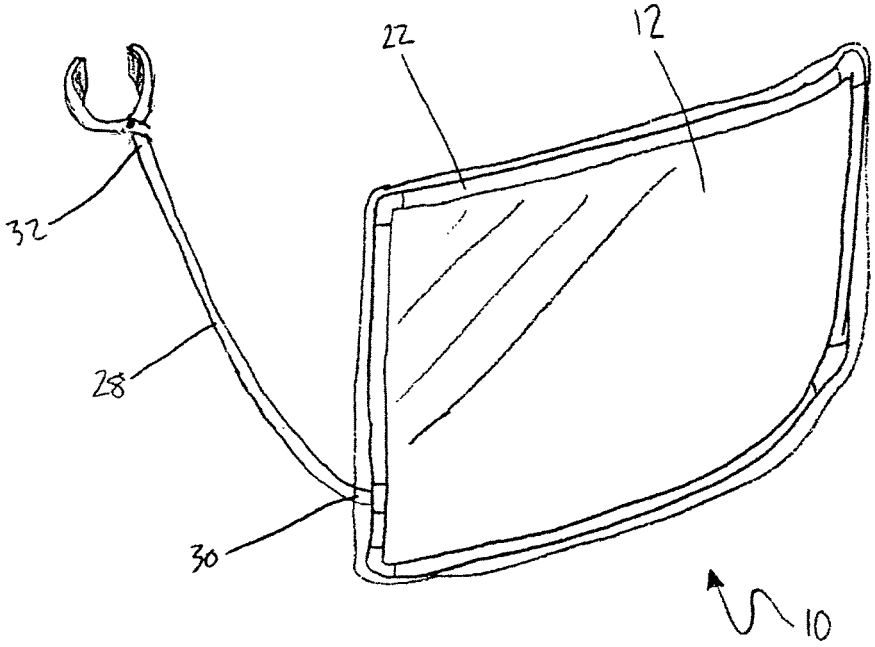

In a second example shown in FIG. 2, the movable frame 14 can include a plurality of members 24,24', etc. extending from a common joint 26. The members 24,24', etc. can be arcuate in shape. Alternatively, the members 24,24', etc. can comprise a plurality of generally straight members having two 90° bends, such as shown in the drawing.

Figure 3:
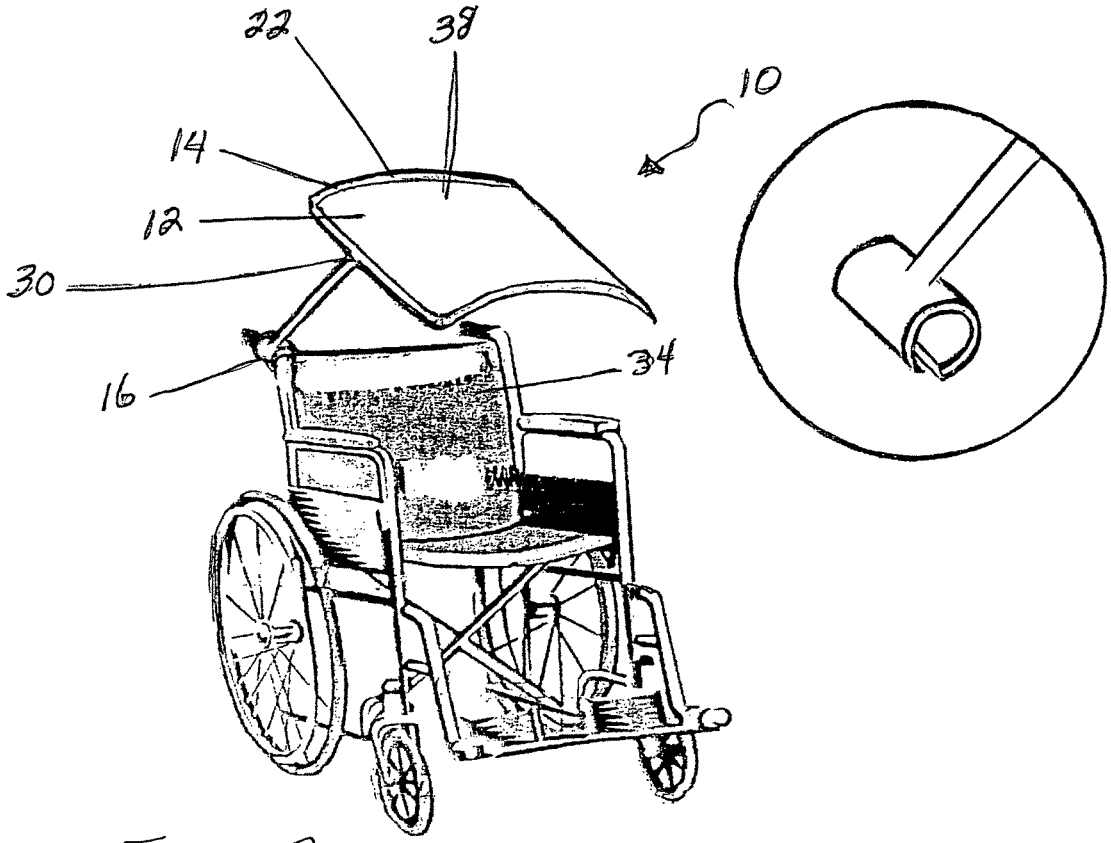
FIG. 3 is a perspective view of a third embodiment of the present invention hereof.
Figure 4:
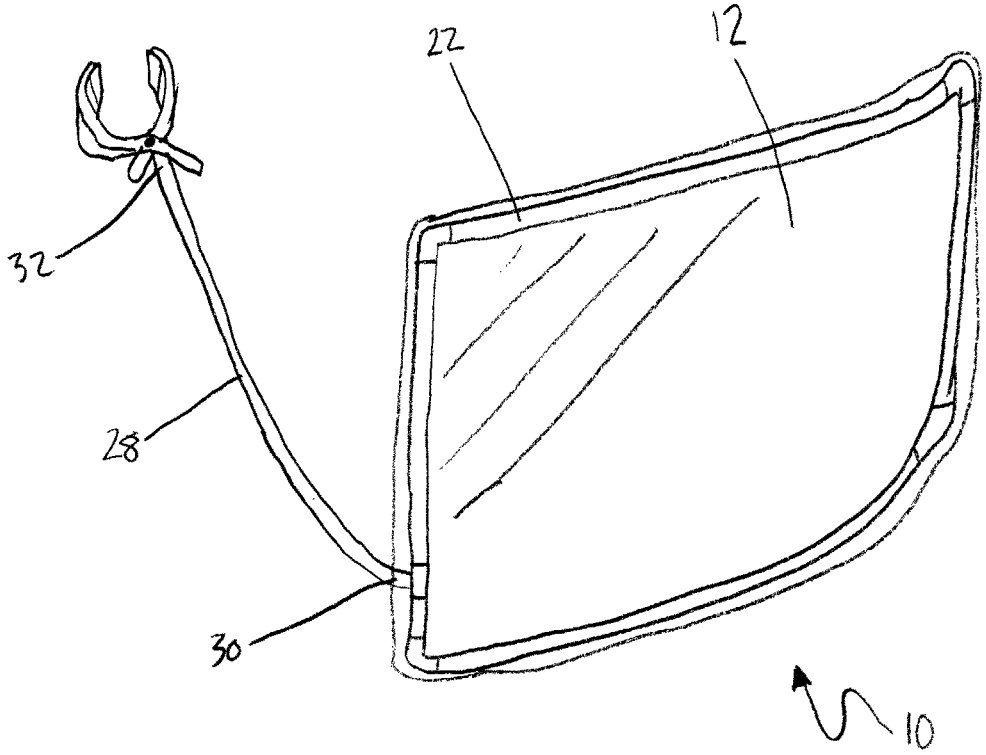
FIG. 4 is an enlarged perspective view of the third embodiment of the present invention.

In a third example shown in FIGS. 3 and 4, the movable frame 14 includes the support frame 22 upon which the translucent material 12 is attached. The frame 14 can also include an arm 28 having a first end 30 connected to one of the interconnected members. A second end 32 of the arm 28 is connected to the means for attaching 16 the movable frame 14 to the patient handling device 34. The movable frame 14 can include any suitable number of arms 28, although the specific embodiment shown in FIGS. 3 and 4 only requires a single arm 28. The arm 28 itself is bendable, or pivotable, and can comprise any suitable flexible resilient member which retains its position. The arm 28 can be formed from any suitable material which is both flexible and resilient, such as a metal, plastic, or composite material. Alternatively, the arm 28 can include at least one rigid member having a pivotable joint at the first end and/or second end thereof. In this regard, the arm 28 can be pivotable at the first end 30 connected to the frame 22 and/or the second end 32 at the patient handling device 34.

As discussed further below, it is to be appreciated that the screen 10 can be removed from and repositioned on the patient handling device 34 as desired, such as being positioned on either side of the device 34.

As is now understood, the primary objective of the movable frame 14 is to provide adequate structure upon which the translucent material 12 is attached. The movable frame 14 also includes sufficient structure for attachment to the means for attaching 16 the movable frame to the patient handling device 34.

The movable frame 14 is formed from any suitable structure or material, for instance, a metal, a polymer, a composite material, or the like. The various members and arms in the movable frame 14 can be secured to each other using any suitable means, such as fasteners, welding, adhesives, etc.

The means for attaching 16 the movable frame 14 to the patient handling device 34 can include any suitable device or structure. For instance, the means for attaching 16 can include a permanent attachment, such as welding the frame 14 to the patient handling device 34. The means for attaching 16 can also utilize threaded fasteners or other similar means. Preferably, the means for attaching 16 allows the screen 10 to be quickly and easily moved from one patient handling device 34 to another. Therefore, the means for attaching 16 preferably comprises a clamp 36 which can be easily repositioned on the patient handling device 34. In addition, the clamp 36 also firmly holds the screen 10 in position, yet can be easily and quickly operated by hand and without the use of any additional tools.

The translucent, or semi-transparent material 12 comprises any suitable material which allows the patient to see clearly through it when the material 12 is in close proximity to the patient's face, yet not allow any bystanders to identify the patient when looking through the material 12 from further away. The distance at which a bystander can see through the material 12 will depend upon (at a minimum): (1) the amount of light both in front of and behind the material 12; (2) the bystander's distance from the material 12; and (3) the distance between the patient's face and the material 12. Preferably, the minimum necessary distance to conceal the patient from the bystander is about 6 inches to about 6 feet away. For use in some applications, it is desirable that the health care providers administering aid to the patient can see through the material 12 to monitor the patient's condition, and therefore it is preferable to be able to see through the material 12 from a distance of several feet away. Preferably, the translucent material 12 is a plastic film, such as one which is reflective and sold under the trademark Mylar®.

As mentioned above, the distance between the translucent material 12 and the patient's face is also another factor regarding whether the patient can be seen through the material 12. In general, the closer the patient's face is to the material 12, the easier it is to identify and see the patient's face through the material 12. In this regard, the movable frame 14 can be positioned closer or farther from the patient's face by the health care providers in order to manipulate the visibility of the patient. For example, if the health care provider wants to see the patient's face through the material 12, he or she can move the frame 14 and material 12 closer to the patient's face. If it is desirable to have the patient not be visible through the material 12, then the frame 14 and material 12 can be moved farther from the patient to reduce visibility.

The translucent material 12 can also be any suitable fabric 38 which conceals the patient's identity yet allows the patient to view outwardly therethrough. For instance, the material 12 can be a veil, a cloth, or the like. It is understood that such materials can be seen through when positioned close to one's eyes, yet sufficiently semi-transparent or nontransparent from a distance. While a silhouette of the patient's face may be visible to a bystander, the patient's facial features are not visible, and thus the patient cannot be identifiable behind the material 12. The material 12 can also even be nontransparent to bystanders, not allowing bystanders to see anything behind the material 12.

The translucent material 12 is secured to the movable frame 14 using any suitable means which are well-known to one having ordinary skill in the art, including the use of adhesives, being sewn together, hook-and-loop fasteners such as those sold under the trademark VELCRO®, mechanical fasteners like clips, or the like.

The translucent material 12 can also have any suitable color or tint to it. For example, when the translucent material 12 is a fabric, the material 12 may be colored yellow to represent that the patient has a contagious affliction. As understood by those having ordinary skill in the art, yellow is a color which is customarily used to indicate a contagion. In another example, red and white candy stripes can be used for children. It is to be understood that these are just examples, and that any number of suitable alternative color schemes can be used.

In yet another aspect, the translucent material 12 can be formed from any material which is suitable for use with face masks, or surgical masks. Masks of these types are formed from paper or nonwoven materials and are efficient at blocking bacteria and viruses from passing through. In this regard, the screen 10 can be used in lieu of a mask.

To that end, the material 12 can comprise any suitable type of material which is commonly used for blocking contagions, such as single-layer spunbonded polypropylene for basic coverage or tri-layer SMS fabric for increased fluid protection. As understood by one having ordinary skill in the art, an SMS fabric is a tri-layer material having a meltblown layer sandwiched by spunbonded nonwoven materials.

Optionally, the screen 10 can include two or more materials 12 in which the first material is translucent, and the second material is a contagion block of the type discussed above. In this regard, the second material can be easily removed, such as using hook-and-loop fasteners like those sold under the trademark Velcro®, or simply being draped over the first material 12.

As referenced throughout, a "patient handling device" is intended to encompass any device which a patient might sit on, lie on, or otherwise use or be transported on. For instance, the patient handling device 34 can include a hospital bed, a stretcher, a gurney, a wheelchair, or the like.

In use, the screen 10 is initially in a retracted position to the side of or atop, where the patient's head is to be located on the patient handling device 34. The screen 10 can also be entirely detached from the patient handling device 34. The retracted position is in any suitable location that allows the patient to get on or off the patient handling device 34 without the screen 10 getting in his or her way. The patient is then positioned on the patient handling device 34 and the screen 10 is moved from the retracted position to a shielded position in front of the patient's face. The range of motion or movement of the screen 10 will depend upon the specific type of movable frame 14 being used therewith. For instance, for a screen 10 having a movable frame 14 like that shown in FIG. 1, the frame 14 is pivoted toward the "head" end of the stretcher so that the patient can be placed on the stretcher. The frame 14 is then pivoted over the patient's face once the patient is in place on the patient handling device 34.

If the movable frame 14 is similar to that shown in FIG. 2, then the retracted position would include each of the arcuate members 24,24', etc. being pivoted toward the "head" end of the stretcher. After the patient has been placed on the stretcher, the arcuate members 24,24', etc. are then pivoted in position over the patient's face toward the "foot" end.

If the movable frame 14 is similar to that shown in FIG. 3 or 4, then the retracted position can simply be pivoting or moving the frame 14 to the side of the patient handling device 34. Once the patient sits/lies on the patient handling device 34, the frame 14 can then be moved in front of the patient's face to conceal his or her identity.

It is to be understood that the invention is not limited to the specific embodiments shown in FIGS. 1-4. Also, the various embodiments in the drawings are not to be limited to use with those patient handling devices specifically shown in the drawings. That is, any suitable embodiment of the invention can be used with any suitable type of patient handling device as determined by one having ordinary skill in the art.

In addition, while the translucent material has been described above with reference specifically to a plastic film or a fabric, it is to be understood that any other suitable material can be used herewith.

It is to be appreciated that the present invention provides a screen for concealing a patient's identity which is versatile, can be removable (from the patient handling device), and positionable with respect to its orientation and distance from the patient's face. It can also be used in lieu of a mask for blocking contagions.

As is apparent from the preceding, the present invention provides a screen which is effective at concealing a patient's identity and which also allows the patient to view his or her surroundings outwardly through the screen.

What is claimed is:

1. A patient handling device with a screen for shielding a patient's face, the patient handling device comprising:

(a) a movable frame comprised of at least one arm that is bendable or pivotable about a ioint located at a terminal end of the at least one arm, the movable frame being movable from a retracted position to a shielded position by bending or pivoting the at least one arm; and (b) means for attaching the movable frame to the patient handling device, wherein the means for attaching are located at the terminal end of the at least one arm;

wherein the screen comprises a translucent material supported by a support frame, the translucent material being a reflective plastic film that is secured to the movable frame via the support frame, wherein the screen is configured such that the patient can see through the screen at a first distance, but cannot see through the screen at a second distance, wherein the second distance is greater than the first distance.

2. The patient handling device of claim 1, wherein the patient handling device is a wheelchair.

3. The patient handling device of claim 1, wherein the patient handling device is a bed, a stretcher, or a gurney.

4. A screen for shielding a patient's face comprising:

(a) a movable frame including a plurality of interconnected members and at least one arm having a first end and a second end, the first end of the arm being connected to one of the interconnected members;

(b) means for attaching the movable frame to an apparatus upon which the patient is positioned, the means for attaching the movable frame being connected to the second end of the arm; and (c) a translucent material supported by a support frame, the screen secured to the movable frame via the support frame, wherein the screen is configured such that the patient can see through the screen at a first distance, but cannot see through the screen at a second distance wherein the second distance is greater than the first distance.

5. The screen of claim 4, wherein the translucent material is a reflective plastic film.

6. The screen of claim 4, wherein the material is a veil.

7. The screen of claim 4, wherein the means for attaching comprises a clamp that is repositionable on the apparatus.

8. The screen of claim 4, wherein the arm is bendable.

9. The screen of claim 4, wherein the arm is rigid and includes a pivotable joint at least one of the first or second ends thereof.

10. A patient handling device with a screen for shielding a patient's face, the patient handling device comprising:

(a) a movable frame comprised of at least one arm that is bendable or pivotable about a joint located at a terminal end of the at least one arm, the movable frame being movable from a retracted position to a shielded position by bending or pivoting the at least one arm; and (b) means for attaching the movable frame to the patient handling device, wherein the means for attaching are located at the terminal end of the at least one arm;

wherein the screen comprises a translucent material supported by a support frame, the screen secured to the movable frame via the support frame, the translucent material being made with spunbonded material, wherein the screen is configured such that the patient can see through the screen at a first distance, but cannot see through the screen at a second distance, wherein the second distance is greater than the first distance.

11. The patient handling device of claim 10, wherein the patient handling device is a bed, a wheelchair, a stretcher, or a gurney.

12. The patient handling device of claim 10, wherein the spunbonded material is spunbonded polypropylene.

13. The patient handling device of claim 10, wherein the spundbonded material is a tri-layer material having a melt-blown layer sandwiched by spunbonded nonwoven materials.

* * * * *